US005189803A

United States Patent [19]

Caywood

[11] Patent Number: 5,189,803

[45] Date of Patent: Mar. 2, 1993

[54] DEVICE FOR MEASURING THE FIRST DOWN IN FOOTBALL

[75] Inventor: Alvin J. Caywood, Garland, Tex.

[73] Assignee: Dalco Athletic Lettering, Inc., Garland, Tex.

[21] Appl. No.: 733,700

[22] Filed: Jul. 22, 1991

[51] Int. Cl.[5] ..... G01C 15/00

[52] U.S. Cl. ..... 33/289; 33/293; 40/598

[58] Field of Search ..... 33/289, 18.1, 293, 756, 33/759; 116/200; 273/55 R; 40/598, 606; 182/108

[56] References Cited

U.S. PATENT DOCUMENTS

| | | | |
|---|---|---|---|
| 2,060,165 | 11/1936 | Borleske | 33/289 |
| 2,280,682 | 4/1942 | Baker | 33/289 |
| 3,119,588 | 1/1964 | Keats | 40/606 |
| 3,738,014 | 6/1973 | Sproul | 33/289 |
| 3,768,435 | 10/1973 | Dicker | 33/289 |
| 3,799,109 | 3/1974 | Vargo | 40/598 |

OTHER PUBLICATIONS

*Kalamazoo Gazette,* Jack Moss, Ed., "Sports & Classified", D1, Apr. 12, 1989, and Jul. 18,1989.

*Kalamazoo Gazette*, "Sports", K1, Jack Moss, Ed, Apr. 23, 1989.

Letter from Jim Mullendore to A. L. Birdsall, dated May 24, 1989.

Letter from James W. Lessig to MAC Football Coaches, Dated: Sep. 8, 1989.

Letter from Fredrick D. Sible to Albert L. Birdsall, Dated: Oct. 24, 1988.

Letter from Art McNally to Albert L. Birdsall, Dated: Nov. 20, 1989.

*Kalamazoo Gazette,* D7, Jack Moss, Editor, Dec. 14, 1989.

Memo from AlMode to NCAA Rules Committee, Dated: Dec. 18, 1989.

Letter from Ronald E. Commissaris to William Bupp, Dated: Dec. 27, 1989.

Letter from David Witvoet to Whom it may concern, Dated: Dec. 29, 1989.

Letter from Dick Schindler to Whom it may concern, Dated: Feb. 18, 1991.

*Kalamazoo Gazette,* "Business Bulletin," Dated: Mar. 17, 1991.

*Primary Examiner*—William A. Cuchlinski, Jr.
*Assistant Examiner*—Alvin Wirthlin
*Attorney, Agent, or Firm*—Harry C. Post, III

[57] ABSTRACT

A device for measuring the position of a football on a football playing field has a base member adapted to be placed in juxtaposition on a yard line on the football playing field. A first elongated member to determine the distance the football is positioned relative to the base. A second elongated member visually indicates the location of the base. First pivotal mounting is used to pivotally connect the first elongated member to the base to permit the first elongated member to be selectively rotated into engagement with the second elongated member and into a measuring position. Second pivotal mounting apparatus may be used to pivotally connect the second elongated member to the base so that the base remains substantially in juxtaposition with the line on the field when the first and second members are moved relative to the base when marking the position of the football on the field. The base may include a surface disposed to face the football field and a serration disposed in the surface to provide a shoulder to prevent slippage of the base relative to the football field. Indicating apparatus may be connected to the second elongated member for indicating the position of the base on a yard line. A clamping device is adapted to be secured to the first elongated member for indicating the location of the football along the first elongated member when positioned in the measuring position.

11 Claims, 3 Drawing Sheets

DEVICE FOR MEASURING THE FIRST DOWN IN FOOTBALL

TECHNICAL FIELD

This invention relates to a measuring device and; more particularly, a device for measuring the position of a football on a football playing field.

BACKGROUND ART

It is well known that a football is traditionally marked or located on a football field using a chain connected at each end to an indicating pole. The chain has a length of approximately 10 yards so that the indicating poles are 10 yards from each other when the chain is extended. However, the distance between the indicating poles may vary by plus or minus ¾ inch because the chain is constructed from links having a length of 1½ inch. Further, the chain is constructed of metal which may cause injury to a player, spectator, or other attendee at the football game or practice. Further, the chain is of such a length that it may become entangled with electrical cords or other items located along the sideline of the field.

To overcome these and other problems, a football measuring device called the "Quick Stick" has been suggested by Mr. Albert L. Birdsall and its use demonstrated. This measuring device is composed of an upright handle fixed to a four inch wide base, an eight foot measuring arm that pivots left or right from the base and a locking slide with a spring indicator. The measuring arm covers in excess of half the 5-yard divisions of a football field. The locking slide is composed of a tube, which slides along the measuring arm, and a device that locks into position on the measuring arm, holding in that position until released for the next measurement. There is also a spring that is used as an indicator of the exact position of the football. The base sits astride the 5-yard marker closest to the position of the ball when it is marked for play by an official. The measuring arm is then laid down in the direction of the football. The slide is unlocked and moved so that the spring indicator marks the forward point of the football and then is locked into position. The device may then be moved 10 yards down field ready for a measurement.

Although this prior art device works well, it is not as accurate as one desires. The inaccuracy occurs when a single individual perform the measurement and is created by the upright handle being fixed to the base. When a single person is using the device and rotates the handle so that the measuring arm is laying on the surface of the field, the base is rotated relative to the field to thereby cause the measuring arm to be moved longitudinally of the center of the 5-yard strip.

Further, this prior art device is not as accurate as one would desire because the base is made from metal and may inadvertently slide relative to the surface of the football field when moving the measuring arm into the measuring position.

Further, this prior art device does not include a indicator mechanism to be used as a reminder as to the position of the base on a particular yard line.

Further, this prior art device does not include a clamping device adapted to be selectively connected to the measuring arm to indicate the location of the football along the measuring arm.

Accordingly, it is an object of the present invention to provide a measuring device that is more accurate than the prior art measuring device by providing a pivotal connection between the handle and base.

Further, it is an object of the present invention to provide a measuring device that is more accurate than the prior art measuring device by providing serrations in the base to assist in preventing it from sliding.

Further, it is an object of the present invention to provide a measuring device that includes an indicator mechanism to be used as a reminder as to the position of the base on a particular yard line.

Further, it is an object of the present invention to provide a measuring device that includes a clamping device adapted to be selectively connected to the measuring arm to indicate the location of the football along the measuring arm.

DISCLOSURE OF THE INVENTION

In accordance with the present invention, there is provided a device for measuring the position of a football on a football playing field has a base member adapted to be placed in juxtaposition on a yard line on the football playing field. A first elongated member to determine the distance the football is positioned relative to the base. A second elongated member visually indicates the location of the base. First pivotal mounting is used to pivotally connect the first elongated member to the base to permit the first elongated member to be selectively rotated into engagement with the second elongated member and into a measuring position. Second pivotal mounting apparatus may be used to pivotally connect the second elongated member to the base so that the base remains substantially in juxtaposition with the line on the field when the first and second members are moved relative to the base when marking the position of the football on the field.

Further, in accordance with the present invention there is provided a device for measuring the position of a football on a football playing field has a base member adapted to be placed in juxtaposition on a yard line on the football playing field. A first elongated member to determine the distance the football is positioned relative to the base. A second elongated member visually indicates the location of the base. First pivotal mounting is used to pivotally connect the first elongated member to the base to permit the first elongated member to be selectively rotated into engagement with the second elongated member and into a measuring position. The base includes a surface disposed to face the football field and a series of serrations disposed in the surface to provide a shoulder that prevents slippage of the base relative to the football field.

Further, in accordance with the present invention there is provided a device for measuring the position of a football on a football playing field has a base member adapted to be placed in juxtaposition on a yard line on the football playing field. A first elongated member to determine the distance the football is positioned relative to the base. A second elongated member visually indicates the location of the base. First pivotal mounting is used to pivotally connect the first elongated member to the base to permit the first elongated member to be selectively rotated into engagement with the second elongated member and into a measuring position. Indicating apparatus is connected to the second elongated member for indicating the position of the base on a yard line.

Further, in accordance with the present invention there is provided a device for measuring the position of a football on a football playing field has a base member adapted to be placed in juxtaposition on a yard line on the football playing field. A first elongated member to determine the distance the football is positioned relative to the base. A second elongated member visually indicates the location of the base. First pivotal mounting is used to pivotally connect the first elongated member to the base to permit the first elongated member to be selectively rotated into engagement with the second elongated member and into a measuring position. A clamping device is adapted to be secured to the first elongated member for indicating the location of the football along the first elongated member when positioned in the measuring position.

BRIEF DESCRIPTION OF THE DRAWINGS

Other objects and advantages of the invention will become apparent upon reading the following detailed description and upon reference to the drawings, wherein like reference characters are used throughout to designate like parts.

BEST MODE FOR CARRYING OUT THE INVENTION

Figure 1:
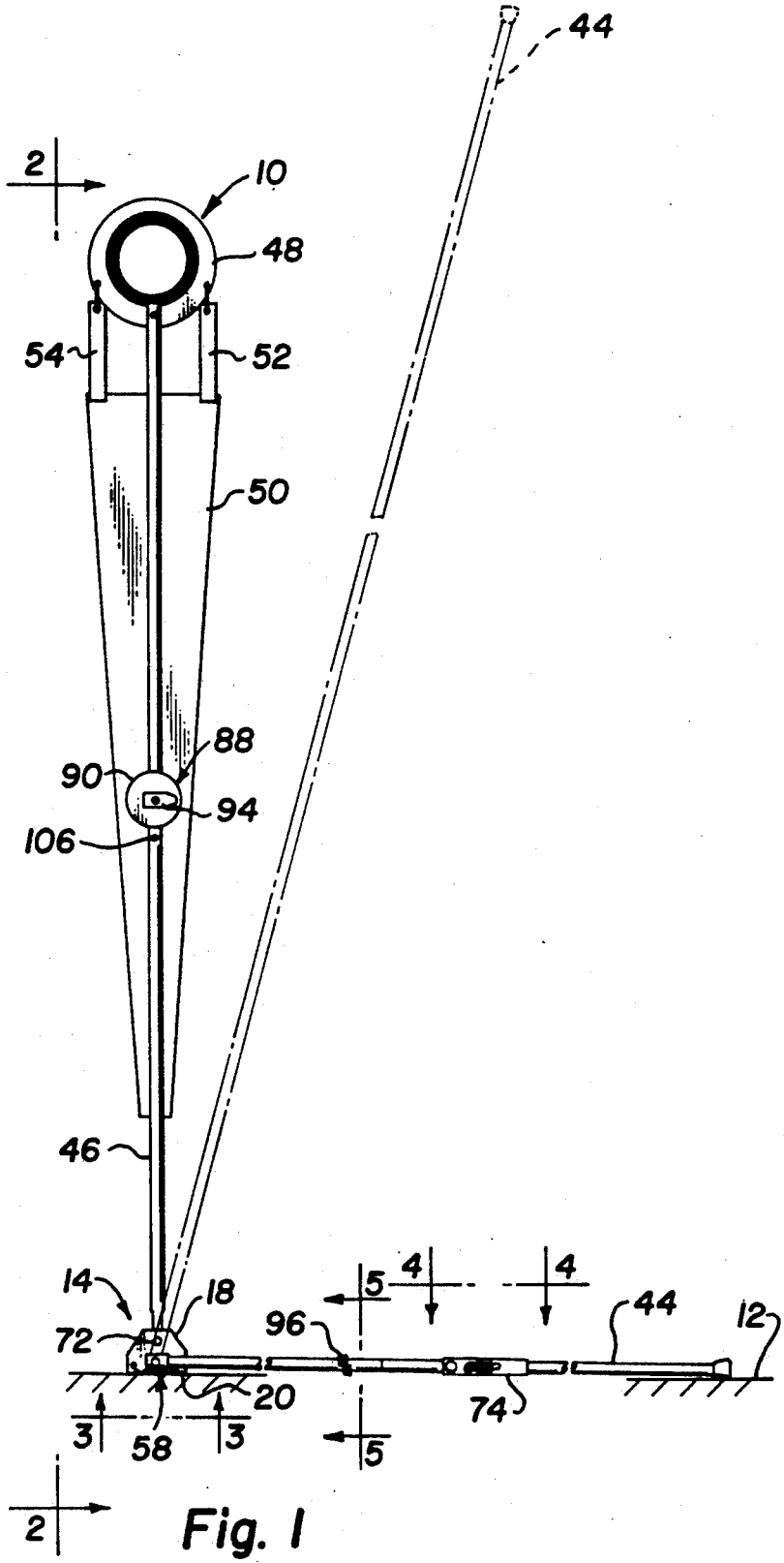
FIG. 1 is a front elevational view of a measuring device constructed in accordance with the present invention.
Figure 2:
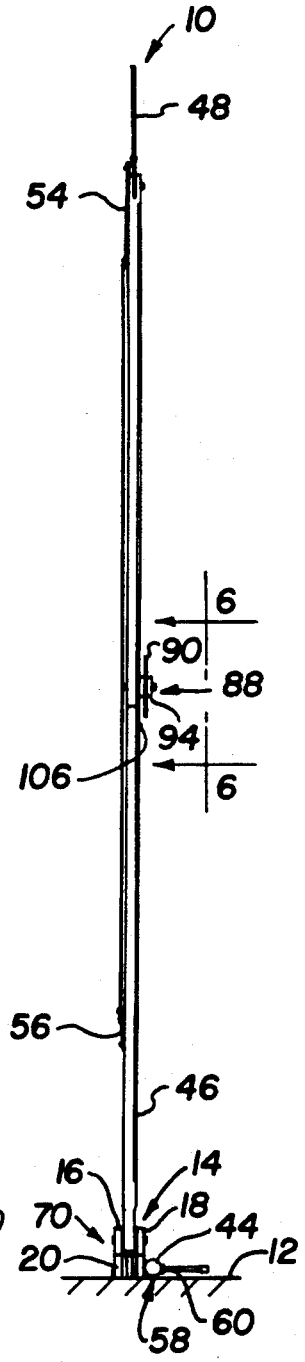
FIG. 2 is a side elevational view taken along the line in the direction of arrows 2—2 of the measuring device shown in FIG.1.

Turning now to FIGS. 1 and 2, there is shown a device 10 for marking the position of a football on a conventional football playing field 12.

Figure 3:
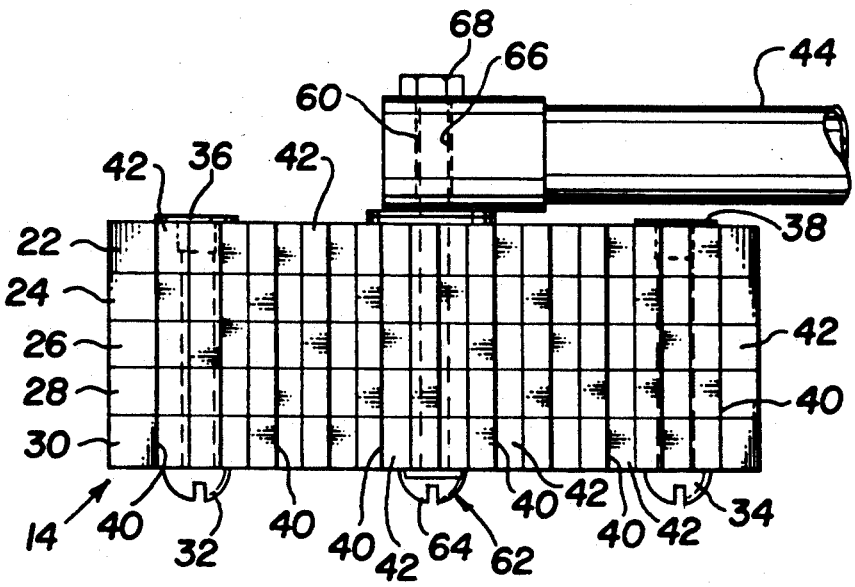
FIG. 3 is an enlarged view of a portion of the invention shown in FIG. 1, taken along the line in the direction of arrows 3—3.

As best seen in FIGS. 1-3, a base 14 is adapted to be placed in juxtaposition on a yard line on football playing field 12. It is preferred that the yard line upon which base 14 is placed is a line evenly divisible by 5, eg. 10, 25, 45, or 50. Base 14 is a generally U-shaped member having first and second sides 16 and 18, respectively, extending substantially parallel to one another from a base member or connecting member 20 connecting parallel sides 16 and 18 to one another. To protect players from possible injury when accidentally contacting the metallic base of the prior art device, base 14 is constructed of five substantially flat, non-metallic members 22, 24, 26, 28 and 30 disposed with the flat sides facing one another, member 22 forming first side 16, member 30 forming second side 18 and flat members 22-30 joined together by attaching bolts 32 and 34 and lock nuts 36 and 38 respectively secured to bolts 32 and 34.

At least one shoulder 40 is provided to prevent slippage of base 14 relative to football field 12 when device 10 is being used to mark the position of the football on football field 12. However, it is preferred that a plurality of shoulders 40 be provided to face the length of football field 12 by providing a series of triangular serrations 42 on base member 20 forming a saw-toothed pattern.

A first elongated member or measuring arm 44 is used to determine the distance the football is positioned relative to base 14. Measuring arm 44 is conventionally made of a non-metallic material and is approximately 8.5 feet in length so as to extend past one-half the distance to the next 5 yard increment on football playing field 12.

A second elongated member or handle 46 is used to indicate the location of base 14 to a spectator. Handle 46 is conventionally made of a non-metallic material and is approximately 6 feet, 10 inches or approximately 8 feet, 6 inches in length so as to be easily perceived by a spectator. To enhance the ability of the spectator to locate handle 46, such handles have conventionally been provided with a bulls-eye 48 and a bright triangularly shaped panel 50 connected to bulls-eye 48 by conventional elastic connectors 52 and 54 and to handle 46 by connector 56.

First elongated member 44 is pivotally connected to base 14 to permit first elongated member 44 to be selectively rotated between a moving position, which is in engagement with second elongated member 46, as shown in dotted outline in FIG. 1, and a measuring position, as shown in solid outline in FIG. 1. This first pivotal connector 58 includes an axle rod 60, which is part of a bolt 62 having a head 64, connected to and extending outwardly of base member 14 and through an aperture 66 through first elongated member 44, and a nut 68 connected to the outboard end of rod 60 to thereby pivotally connect first elongated member 44 to base 14.

As best seen in FIG. 1-2, second pivotal connecting apparatus 70 connects second elongated member 46 to base 14 so that base 14 remains substantially in juxtaposition with the line on field 12 when first and second members 44 and 46, respectively, are moved relative to base 14 when marking the position of the football on field 12. Second pivotal connecting apparatus 70 includes a rod 72 forming an axial around which second elongated member 46 pivots when rod 72 extends through an aperture in second elongated member 46. Rod 72 is formed by a bolt and lock nut, which are similar to bolt 32 and lock nut 36, that are disposed to extend between first and second sides 16 and 18, respectively, when secured to base 14.

Figure 4:
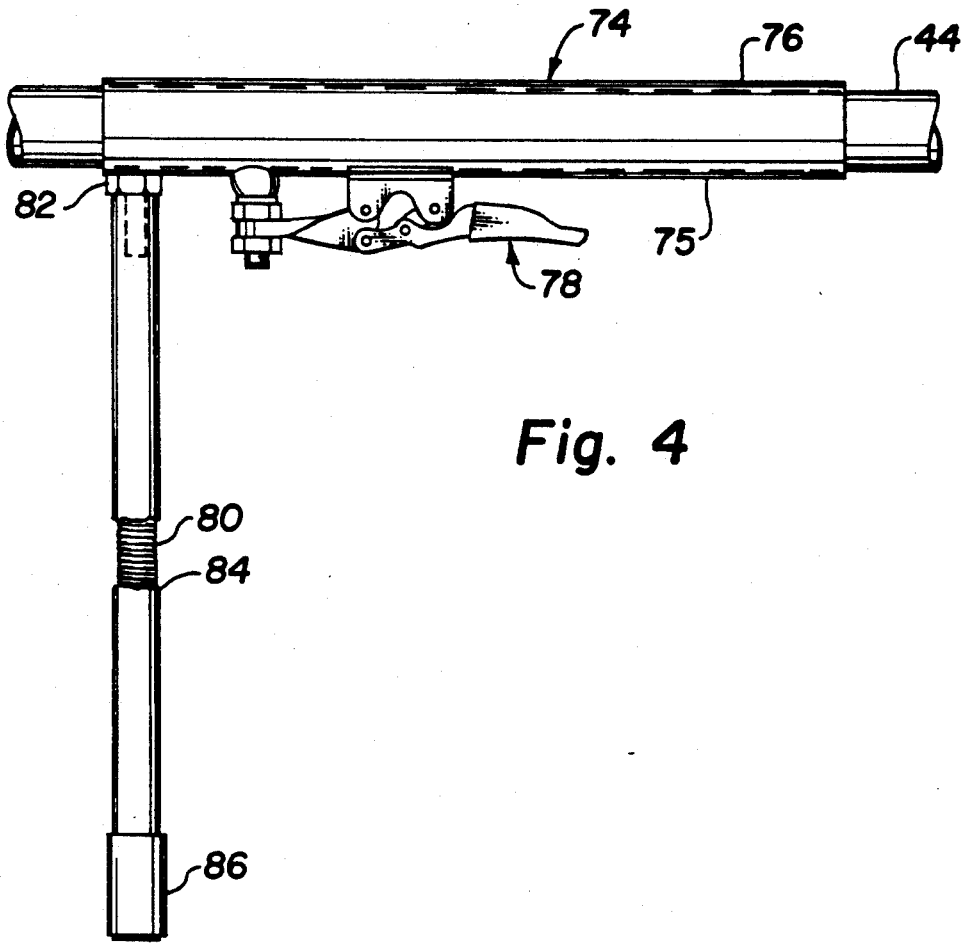
FIG. 4 is an enlarged view of a portion of the invention shown in FIG. 1, taken along the line in the direction of arrows 4—4.

As best seen in FIGS. 1 and 4, a pointing device 74 is slidingly connected to first elongated member 44 to indicate the position of the football along first member 44 relative to base 14. As is conventional, pointing device 74 has a locking slide 75, which is composed of a tube 76 that slides along measuring arm 44 and a locking apparatus 78 that locks into position on the measuring arm 44 holding slide 75 in that position until released for the next measurement. A spring 80 is used as an indicator of the exact position of the football and is connected to slide 75 by connecting bolt 82. This invention protects the player from possible injury when the player contacts device 10 by covering spring 80 with a flexible non-metallic wrap 84 and by covering the outboard end of spring 80 with a non-metallic pointing cap 86.

Figure 6:
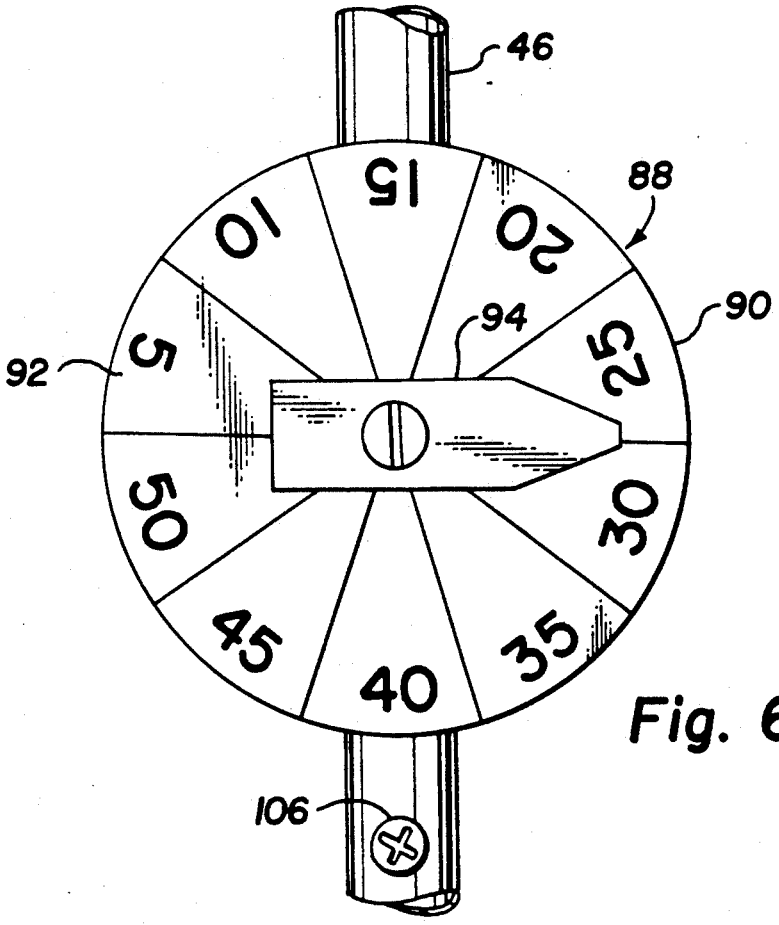
FIG. 6 is an enlarged view of a portion of the invention shown in FIG. 2, taken along the line in the direction of arrows 6—6.

As best seen in FIGS. 1, 2 and 6, indicating apparatus 88 is connected to second elongated member 46 for indicating the position of base 14 on a yard line. Indicating apparatus 88 includes a substantially round dial face 90 having indicators 92 disposed substantially equidistant around the periphery of dial face 90 for representing yard lines in 5 yard increments. A pointer 94 is connected at substantially the center of round dial face 90 so as to be positioned on an indicator coinciding with the line on which said base is positioned. Dial face 90 and pointer 94 are rotatably connected to second elongated member 46 so that pointer 94 points in the same direction as first elongated member 44 and dial face 90 rotated to provide the proper yard indication. In this fashion, the user of device 10 is reminded to not take a measurement in the opposite direction and to place base 14 on the appropriate yard line on playing field 12.

Figure 5:
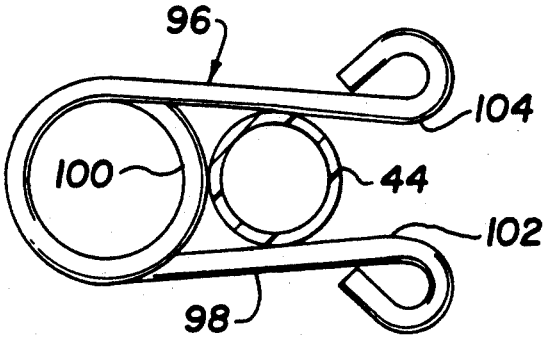
FIG. 5 is an enlarged, sectional view of a portion of the invention shown in FIG. 1, taken along the line in the direction of arrows 5—5.

As best seen in FIGS. 1 and 5, a removably connected clamping device 96 is adapted., to be secured to first elongated member 44 for temporarily indicating the location of the football along first elongated member 44 when positioned in the measuring position. Clamping device 96 is constructed from an elongated wire-like, continuous body 98 conformed with a loop 100 to form a hollow body and opposing clamping shoulders 102 and 104 between which first elongated member 44 is disposed.

Device 10 is used similarly to the prior device previously described, except that dial face 90 and pointer 94 are positioned as previously described when marking the position of the football on playing field 12.

If desired to decrease the size of device 10 for portability, second elongated member 46 may be constructed from two tubular parts and connected with a screw 106 used to connected the two tubular parts.

The invention having been described, what is claimed is:

1. A device for measuring the position of a football on a football playing field comprising: a base adapted to be placed in juxtaposition on a yard line on the football playing field; a first elongated member to determine the distance the football is positioned relative to said base; a second elongated member to visually indicate the location of said base; first means for pivotally connecting said first elongated member to said base to permit said first elongated member to be selectively rotated into engagement with said second elongated member and into a measuring position; and second means for pivotally connecting said second elongated member to said base so that said base remains substantially in juxtaposition with the line on the field when said first and second members are moved relative to said base when marking the position of the football on the field.

2. A measuring device as set forth in claim 1, further comprising: said base including a surface disposed to face the football field and a serration disposed in the surface to provide a shoulder to prevent slippage of said base relative to the football field.

3. A measuring device as set forth in claim 1, further comprising: said base including a generally U-shaped member having first and second sides extending substantially parallel to one another and a base member connecting the parallel sides to one another; and said second pivotal connecting means including a rod extending through an aperture in said second elongated member and connected to the first and second sides to form an axis around which said second elongated member pivots.

4. A measuring device as set forth in claim 1, further comprising: said first pivotal connecting means including a rod connected to and extending outwardly of said base member and through an aperture through said first elongated member and securing means connected to the outboard end of rod to pivotally connect said first elongated member to said base.

5. A measuring device as set forth in claim 1, further comprising: a pointing device connected to said first elongated member to indicate the position of the football along said first member relative to said base.

6. A measuring device as set forth in claim 1, further comprising: numerical indicating means connected to said second elongated member for numerically indicating the position of said base on a discrete yard line.

7. A measuring device as set forth in claim 6, further comprising: said numerical indicating means further including a substantially round dial face having indicators disposed substantially equidistant around the periphery of the dial face for representing yard lines in 5 yard increments and a pointer pivotally connected to the center of the round dial face so as to be positioned on an indicator coinciding with the line on which said base is positioned.

8. A measuring device is set forth in claim 1, further comprising: a removably connected clamping device adapted to be secured to said first elongated member for temporarily indicating the location of the football along said first elongated member when positioned in the measuring position.

9. A measuring device as set forth in claim 8, further comprising: said removably connected clamping device further including a continuous body being conformed to provide opposing clamping shoulders between which said first elongated member is disposed.

10. A device for measuring the position of a football on a football playing field, comprising: a base member adapted to be placed in juxtaposition on a yard line on the football playing field; a first elongated member to determine the distance the football is positioned relative to said base; a second elongated member to visually indicate the location of said base; first means for pivotally connecting said first elongated member to said base to permit said first elongated member to be selectively rotated into engagement with said second elongated member and into a measuring position; and numerical indicating means connected to said second elongated member for numerically indicating the position of said base on a discrete yard line, said numerical indicating means further including a substantially round dial face having indicators disposed substantially equidistant around the periphery of the dial face for representing yard lines in 5 yard increments and a pointer pivotally connected to the center of the round dial face so as to be positioned on an indicator coinciding with the line on which said base is positioned.

11. A device for measuring the position of a football on a football playing field, comprising: a base adapted to be placed in juxtaposition on a yard line on the football playing field, said base including a generally U-shaped member having first and second sides extending substantially parallel to one another and a base member connecting the parallel sides to one another to form the base of the U, the base of the U having a surface disposed to face the football field and a series of triangular serrations disposed in the base of the U to provide a series of shoulders forming a saw-toothed pattern to prevent slippage of said base relative to the football field; a first elongated member to determine the distance the football is positioned relative to said base; a second elongated member to visually indicate the location of said base; first means for pivotally connecting said first elongated member to said base to permit said fist elongated member to be selectively rotated into engagement with said second elongated member and into a measuring position, said first pivotal connecting means including a rod connected to and extending outwardly of said base and through an aperture through said first elongated member and securing means connected to the outboard end of the rod to pivotally connect said fist elongated member to said base; second means for pivotally connecting said second elongated member to said base so that said base remains substantially in juxtaposition with the line on the field when said first and second members are moved relative to said base when marking the position of the football on the field, said second pivotal connecting means including a rod extending through an aperture in said second elongated member and connected to the first and second sides to form an axis around which said second elongated member pivots; a pointing device connected to said first elongated member to indicate the position of the football along said first member relative to said base; and numerical indicating means connected to said second elongated member to numerically indicating the position of said base on a yard line, said numerical indicating means further including a substantially equidistant around the periphery of the dial face for representing yard lines in 5 yard increments and a pointer pivotally connected to the center of the round dial face so as to be positioned on an indicator coinciding with the line on which said base is positioned.

* * * * *